US005098808A

United States Patent [19]

Tamura

[11] Patent Number: 5,098,808

[45] Date of Patent: Mar. 24, 1992

[54] ELECTROPHOTOGRAPHIC PHOTORECEPTOR COMPOSITION

[75] Inventor: Yukihisa Tamura, Matsumoto, Japan

[73] Assignee: Fuji Electric Co., Ltd., Japan

[21] Appl. No.: 734,046

[22] Filed: Jul. 22, 1991

Related U.S. Application Data

[63] Continuation of Ser. No. 363,210, Jun. 8, 1989, abandoned.

[30] Foreign Application Priority Data

Jun. 21, 1988 [JP] Japan ..... 63-153012

[51] Int. Cl.[5] ..... G03G 5/047

[52] U.S. Cl. ..... 430/59; 430/58

[58] Field of Search ..... 430/58, 59

[56] References Cited

U.S. PATENT DOCUMENTS 4,525,441 6/1985 Takahata et al. ..... 430/42 X
4,657,835 4/1987 Yashiki ..... 430/60
4,971,877 11/1990 Miyamoto et al. ..... 430/58 X

*Primary Examiner*—Roland Martin
*Attorney, Agent, or Firm*—Brumbaugh, Graves, Donohue & Raymond

[57] ABSTRACT

An electrophotographic photoreceptor comprises in sequence:

(a) a conductive base layer; and (b) at least one photosensitive layer applied to the conductive base layer, the photosensitive layer comprising at least one photoconductive organic material and 0.01-3 weight percent of a titanate coupling agent.

The photoreceptor is advantageous in that it exhibits good electrophotographic properties and surface characteristics, and is cost effective in terms of manufacturing.

1 Claim, 1 Drawing Sheet

ELECTROPHOTOGRAPHIC PHOTORECEPTOR COMPOSITION

This application is a continuation of application Ser. No. 07/363,210, filed on June 8,1989 now abandoned.

BACKGROUND OF THE INVENTION

This invention relates to a photoreceptor useful in electrophotography. More particularly, this invention relates to an electrophotographic photoreceptor comprising in sequence a conductive base layer and at least one photosensitive layer applied to the conductive base layer, the photosensitive layer comprising at least one organic material and 0.01–3 weight percent of a titanate coupling agent.

Inorganic materials such as Se, CdS and ZnO have conventionally been employed as photoconductive materials in electrophotographic photoreceptors. However, it has been found that these materials do not always have the properties necessary to function properly in a photoreceptor. As a result, organic photoconductive materials have been recently employed in photoreceptors. When organic materials are employed, the photoreceptor is generally advantageous in terms of plasticity, thermal stability, film formation properties, light transmittance and reduced manufacturing costs. However, such materials are generally disadvantageous in terms of dark resistance and photosensitivity. Accordingly, photoreceptor compositions employing organic materials generally comprise a laminate of layers serving different functions: for example, a layer mainly contributing to charge generation when illuminated, and a layer mainly contributing to maintenance of surface charge in the dark and transportation of charges at the time of illumination. Different organic materials suitable for each of these functions are typically selected, thereby improving the electrophotographic properties of the photoreceptor as a whole.

Although methods such as vacuum deposition have been proposed for the manufacturing of photoreceptors employing an organic material or materials, a coating method of applying the organic material generally predominates due to its cost advantages. In the coating method, a coating liquid is first prepared by dispersing or dissolving a charge-generating material or a charge-transporting material in a solvent together with an appropriate binder material. The coating liquid is thereafter applied to a base layer by a dipping method or the like to provide the above-described layer or layers of the photoreceptor composition. However, the coating method is disadvantageous in that it is apt to produce defects in the coating film surface. Such defects are characterized herein by the specific terms "sag" and "orange peel". As is well known to those skilled in the art, such defects detract from the stability, external appearance, and surface quality of the photoreceptor.

Accordingly, it is the object of this invention to provide an electrophotographic photoreceptor composition comprising at least one photosensitive layer which comprises at least one organic material, the photoreceptor composition having good external appearance, a surface free from coating film defects such as "sag" and "orange peel", excellent electrophotographic properties, and the capability of being produced in a stable form at low cost.

SUMMARY OF THE INVENTION

This objective is achieved, in accordance with the invention by incorporating a titanate coupling agent into the organic material. Thus, the invention is directed to an electrophotographic photoreceptor comprising in sequence:

(a) a conductive base layer; and (b) at least one photosensitive layer applied to the conductive base layer, the photosensitive layer comprising at least one organic material and 0.1–3 weight percent of a titanate coupling agent, the weight percent based upon the solid content of the photosensitive layer.

The photoreceptor of this invention is advantageous in that it has excellent electrophotographic properties, is capable of being produced at a low cost, and avoids "sag" and "orange peel" defects in the coating film which typically arise with the use of organic materials applied by means of a coating method to produce an electrophotographic photoreceptor.

DETAILED DESCRIPTION OF THE INVENTION

Figure 1:
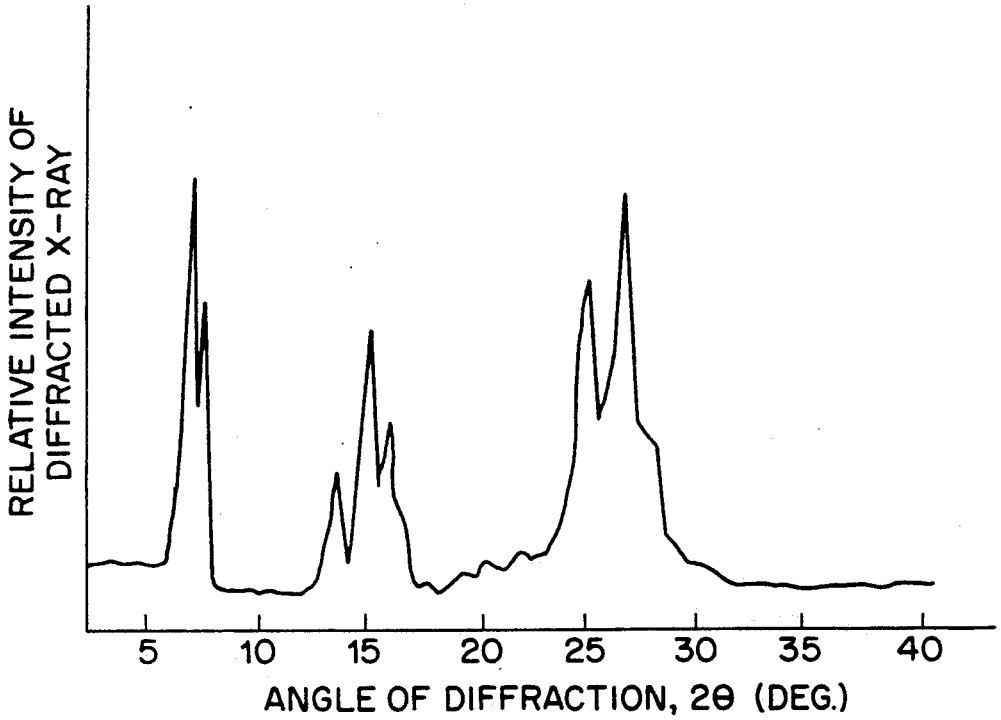
FIG. 1 depicts an X-ray diffraction pattern (Cu-K$\alpha$) of an $\alpha$-type metal-free phthalocyanine compound useful in forming an organic photosensitive layer in one embodiment of the electrophotographic photoreceptor of this invention.

The electrophotographic photoreceptor of this invention comprises in sequence:

(a) a conductive base layer; and (b) at least one photosensitive layer applied to the conductive base layer, the photosensitive layer comprising at least one organic material and 0.1–3 weight percent of a titanate coupling agent.

The conductive base layer is preferably made from aluminum. In one particularly preferred embodiment of this invention, the conductive base layer is a cylindrical aluminum material.

The photosensitive layer or layers comprising the photoconductive organic material and titanate coupling agent are typically applied to the conductive base layer by applying a coating liquid containing the organic material and the titanate coupling agent to produce one or more photosensitive layers. The coating liquid typically comprises an organic material and a binder dispersed in a solvent. In one embodiment of this invention, the organic material is preferably an $\alpha$-type metal-free phthalocyanine or 4-diethylamino-benzaldehyde-diphenylhydrazone, the binder is preferably a polyester or polycarbonate resin, and the solvent is preferably dichloromethane.

The photosensitive layer or layers include enough of the titanate coupling agent to provide a high quality surface. If the amount of titanate coupling agent employed is too small, the coating film obtained to produce the photosensitive layer or layers is apt to produce an "orange peel" effect. On the other hand, if the concentration of titanate coupling agent is too great, the coating film is apt to produce a "sag" effect and deteriorate the electrophotographic properties of the photoreceptor such as retention of surface charge potential. Preferably, the photosensitive layer or layers comprise 0.01–3 weight percent of a titanate coupling agent. As used in this specification and in the appended claims, the weight percent concentration of the titanate coupling agent is based upon the total solid content of the photosensitive layer.

In one particularly preferred embodiment of this invention, the electrophotographic photoreceptor composition comprises in sequence:

(a) a conductive base layer made of aluminum;

(b) a first photosensitive layer applied to the conductive layer, the first layer comprising an organic material which is an α-type metal-free phthalocyanine; and (c) a second photosensitive layer applied to the first layer, the second layer comprising an organic material which is 4-diethylamino-benzaldehyde-diphenylhydrazone, and 0.01–3 weight percent of a titanate coupling agent.

The above-described preferred embodiment is prepared by first applying a coating liquid to the aluminum conductive base layer to produce the above-described first photosensitive layer, and thereafter applying a second coating liquid to the first layer to obtain the above-described second photosensitive layer. An example of this preferred embodiment is set forth in the Example below.

EXAMPLE

One part by weight of an α-type metal-free phthalocyanine having an X-ray diffraction pattern (Cu-Kα) such as that shown in FIG. 1, was heated in a press under a pressure of 10.8 MPA for 2 minutes and thereafter added together with one part by weight of a polyester resin (Byron 200, the trade name of a product produced by Toyo Spinning Company, Ltd.) and 100 parts by weight of dichloromethane and dispersed with stainless beads to prepare a coating liquid to be used in obtaining the above-described first layer.

The coating liquid was then applied by means of a coater to a cylindrical aluminum base which served as the conductive base layer in such a manner that the film thickness after drying was 0.4μm. In this manner, a drum coated with a first photosensitive layer was produced.

Coating liquids Nos. 1–7, to be employed in formulating the above-described second photosensitive layer, were then prepared by respectively adding 0.001, 0.01, 0.1, 1, 3, and 5 weight percent of a titanate coupling agent (KR-TTS, the trade name of a product produced by Ajinomoto Co., Ltd.), to a solution of one part by weight of 4-diethylamino-benzaldehyde-diphenylhydrazone (ABPH, a trade name of a product produced by Takasago Perfumery Co., Ltd.), and one part by weight of a polycarbonate resin (Panlite L-1225, the trade name of a product produced by Teijin Chemicals, Ltd.) in 6 parts by weight of dichloromethane.

Each of the above-described coating liquids Nos. 1–7 were applied as a second layer to the above-described first layer of each aluminum cylinder so that the film thickness of the second layer after drying was 20μm. Thus, the photoreceptors of Examples 1–7 were produced.

The existence or absence of the above-described "sag" and "orange peel" phenomenon on the surfaces of photoreceptors Examples 1–7 as well as their electrophotographic properties were then examined. The results are set forth in Table 1 below.

In Table 1, the mark O in the columns of "sag" and "orange peel" represents "no defect", while the mark x represents "presence of a defect". The marks O and x in the column of electrophotographic properties represent "good properties" and "bad properties", respectively. The marks O x and Δ in the total evaluation represent "good", "slightly bad", and "bad" total properties, respectively.

TABLE 1

| | Example | | | | | | |
|---|---|---|---|---|---|---|---|
| | 1 | 2 | 3 | 4 | 5 | 6 | 7 |
| Amount of Titanate coupling agent added (wt %) | 0.001 | 0.01 | 0.1 | 1 | 3 | 5 | 10 |
| Sag | O | O | O | O | O | x | x |
| Orange Peel | x | O | O | O | O | O | O |
| Electrophotographic Properties | O | O | O | O | O | x | x |
| Total evaluation | x | O | O | O | O | Δ | x |

As shown by Table 1, Examples 2–5, which are embodiments of this invention, exhibited good electrophotographic properties as well as no "orange peel" or "sag" of the photoreceptor surface. Table 1 also illustrates that, to achieve these benefits, it is critical that the titanate coupling agent be employed at a concentration range of 0.01–3 weight percent.

It will be evident that the terms and expressions employed herein are terms of description and not of limitation. There is no intention, in the use of these descriptive terms and expressions, of excluding equivalents of the features described and it is recognized that various modifications are possible within the scope of the invention claimed.

I claim:

1. An electrophotographic photoreceptor comprising in sequence:

(a) a conductive base layer;

(b) a first layer applied to the conductive base layer by a coating method, the first layer comprising an α-type metal-free phthalocyanine; and (c) a second layer applied to the first layer, the second layer comprising 4- diethylamino-benzaldehyde-diphenylhydrazone and 0.01–3 weight percent of a titanate coupling agent, the weight percent based upon the total solid content of the photosensitive layer.

* * * * *